United States Patent [19]

Honjo et al.

[11] 4,030,922

[45] June 21, 1977

[54] IMAGE RECORDING METHOD

[75] Inventors: Satoru Honjo; Seiji Matsumoto, both of Asaka, Japan

[73] Assignee: Fuji Photo Film Co., Ltd., Minami-ashigara, Japan

[22] Filed: Sept. 26, 1975

[21] Appl. No.: 617,130

[30] Foreign Application Priority Data

Sept. 26, 1974 Japan ..... 49-109987

[52] U.S. Cl. ..... 96/1 R; 96/1 M; 96/1 PS; 96/1 E; 96/1 PE; 96/1.1; 250/315 A; 355/3 R

[51] Int. Cl.[2] ..... G03G 13/22

[58] Field of Search ..... 96/1.5, 1 E, 1 R, 1.1, 96/1 M, 1 PE; 250/47 S, 27 S, 315 A

[56] References Cited

FOREIGN PATENTS OR APPLICATIONS 1,552,645 10/1973 Germany

*Primary Examiner*—John D. Welsh

*Attorney, Agent, or Firm*—Sughrue, Rothwell, Mion, Zinn & Macpeak

[57] ABSTRACT

An image recording method for imagewise modulated radiation comprising: forming electric latent images of a radiation image on two or more recording surfaces and then forming an edge enhanced first image and a second image non-edge enhanced or edge enhanced to a small degree in comparison with the first image.

14 Claims, 5 Drawing Figures

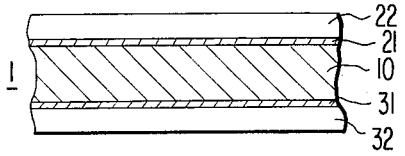
FIG. 1
FIG. 2
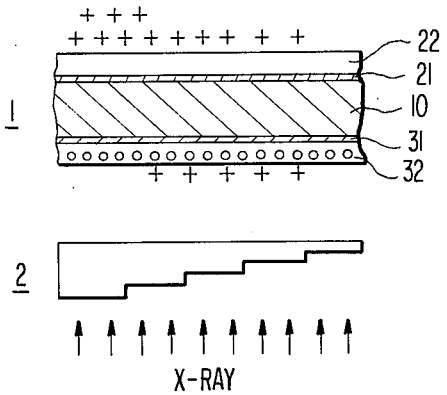
FIG. 3
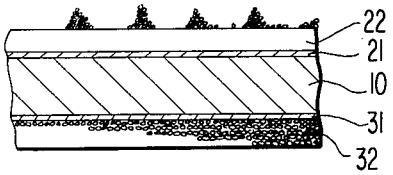
FIG. 4
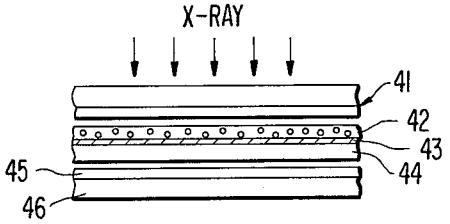
FIG. 5
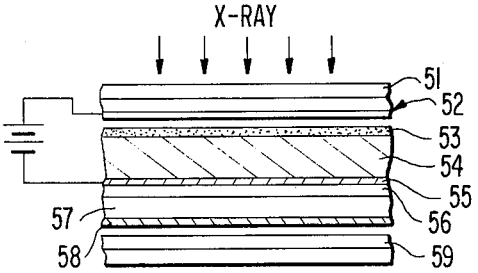

IMAGE RECORDING METHOD

BACKGROUND OF THE INVENTION

1. Field of the Invention

The present invention relates to a novel image recording method. Particularly, it relates to a method suitable for recording an X-ray image.

2. Description of the Prior Art

Images obtained by developing electrostatic latent images generally exhibit edge enhancement and are essentially different from those obtained in silver halide photography. Therefore, images obtained using electrostatic latent images are widely used in the office copying field, since sharp images without fog are obtained. Further, images obtained using electrostatic latent images can provide different diagnostic information from those obtained using silver photography in the field of X-ray image recording, and xeroradiography is used for mammography, for example.

However, it has often been pointed out that for some diseases or parts of the anatomy to be X-rayed, it is diagnostically somewhat disadvantageous to over-enhance the edges since other information is lost.

SUMMARY OF THE INVENTION

Therefore, an object of the present invention is to provide an image recording method which does not exhibit the above described disadvantage.

Another object of the present invention is to provide an image recording method which can provide more information than known methods without increasing the dosage for a patient or an object.

Yet another object of this invention is to provide two images by a one shot exposure, one of the images being edge enhanced and the other being non-edge enhanced or edge enhanced to a smaller degree than said first mentioned edge enhanced image.

The above described objects of the present invention can be attained by forming electric latent images of a radiation image on two or more recording surfaces and then forming an edge enhanced first image and a second image which is non-edge enhanced or which is edge enhanced to a small degree in comparison with the first image.

BRIEF DESCRIPTION OF THE DRAWINGS

FIG. 1 illustrates a sectional view of a typical embodiment of a recording material suitable for achieving the method of the present invention.

FIG. 2 is an illustration showing a latent image formed on the recording material of FIG. 1 upon exposure to X-rays.

FIG. 3 is an illustration showing the recording material after development.

FIG. 4 is an illustration showing an assembly at recording using another embodiment of a recording material.

FIG. 5 is an illustration showing another assembly at recording using still another embodiment of a recording material.

In the figures, numeral 1 designates a recording material, 2 a phantom (i.e., an artificial object which resembles the human body in its absorption of X-rays); 10 a support, 21 an electroconductive layer, 22 an insulating recording layer, 31 an electroconductive layer, 32 an insulating recording layer, 41 a $CaWO_4$ layer (fluorescent screen), 42 a phthalocyanine layer, 43 a Pd layer, 44 a polyethylene terephthalate film, 45 a selenium layer, 46 an aluminum layer, 51 a $CaWO_4$ fluorescent layer, 52 a transparent electrode (NESA glass), 53 a photoelectrophoretic photosensitive liquid layer, 54 a polyethylene film, 55 a $Cu_2I_2$ layer, 56 a vinyl acetate subbing layer, 57 a polyvinylcarbazole layer, 58 a selenium layer, and 59 a $Gd_2O_2S$:Tb layer.

DETAILED DESCRIPTION OF THE INVENTION

In the following a typical embodiment of the present invention will be described by referring to the drawings.

FIG. 1 illustrates a sectional view of the recording material 1 which comprises a support 10 having thereon an electroconductive layer 21 and an insulating recording layer 22 on layer 21 and having an electroconductive layer 31 on the other surface of the support and an insulating recording layer (which term broadly includes photoconductive insulating layers) 32 on layer 31. The electroconductive layers used in the present invention include, for example, metals, metallized plastics, papers and the like which have a surface resistance smaller than $10^9$ $\Omega/cm^2$. Layer 22 is a photoconductive insulating layer (an example of one type of insulating layer) sensitive to, for instance, X-rays. Layer 32 can be the same as layer 22, however, more typically, an electrophotographic recording layer capable of subtractive development, which will be described hereinafter in detail, can be used. Hereinafter in this specification such a layer is designed a photomigration layer.

When layer 22 is identical to layer 32, the latent image carried on one of the layer should be developed using a close development electrode, and the latent image on the upper layer developed using an remote development electrode or without a development electrode.

Both recording layers of the material are first electrostatically charged, usually to the same degree, and then exposed to an X-ray image. It is not important which of layers 22 and 32 is placed closer to the object, if the X-ray absorbance of the support 10 is small, for example, with an aluminum plate about 1 mm thick or with somewhat thinner plastic plate. In some cases, a fluorescent intensifying screen or screens can be superimposed on one surface or both surfaces of the recording material. Fluorescent intensifying screens generally intensify sensitivity but cause a slight loss in resolution power; accordingly, they are generally used where high resolution is not necessary. Electrostatic latent images are formed on the layers 22 and 32 by X-rays which are transmitted by the phantom 2 as shown in FIG. 2. That is, on layer 32 a latent image by charge injection by particles is formed and on layer 22 a usual electrostatic latent image is formed. In a typical case, layer 32 is a photomigration layer and layer 22 is photoconductive insulating layer. Both latent images are developed simultaneously or successively. If the life times of both latent images are not equal, the latent image having a smaller life time should usually be first developed. It is important that layer 22 be capable of providing either an edge enhanced or non-edge enhanced image. However, layer 32, in general, is capable of only providing a non-edge enhanced image since an inner electric field in the layer is used. Needless to say, the situation wherein boty layer 22 and layer 32 provide non-edge enhanced images is not within the invention.

The distinction between edge enhanced and non-edge enhanced images will be obvious to one skilled in the art, and accordingly, these terms should not require further definition. Any difference in degree between edge enhanced images and images edge enhanced to a lesser degree will theoretically provide some results in accordance with the present invention. However, most preferred and most superior results are obtained when a non-edge enhanced image per se is used or an edge enhanced image is used which shows a degree of enhancement of about 1/3 or less that of the edge enhanced image with respect to the contrast transfer function at a spatial frequency between about 5 to about 0.1 (especially 0.2–3) line pairs/mm as compared to the edge enhanced image. This is not, however, a mandatory bound upon the present invention.

Most preferred are those edge enhanced images which show an increase of more than 10%, preferably in the range of about 10% to 25%, in their contrast transfer function at a spatial frequency between about 0.1 to about 5 (especially 0.2–3) line pairs/mm as compared to the response at a lower frequency, e.g., lower than about 0.01 – 0.1 line pairs/mm; again, this preferred limit is by no means mandatory.

A toner is supplied from the outside to layer 22, and a development electrode is either not used or is used at a considerable distance from the recording layer. For example, a considerable distance is more than a few times the thickness of the layer; with a layer 100 microns thick, a considerable distance is about 0.5 mm to about 10 mm. A power cloud developing method is preferred since this method can provide images having good quality. See U.S. Pat. Nos. 3,276,426; 3,357,402; and 3,633,544. On the other hand, layer 32 is immersed in an insulating liquid solvent, such as those disclosed in U.S. Pat. No. 2,907,674, which can dissolve the resin comprising layer 32; one example of a resin-solution combination is the glycerol ester of hydrogenated rosin and xylene. In general, particles at highly exposed areas migrate to layer 31 and deposit there; accordingly, a so-called nega-posi mode is obtained. Therefore, in development of layer 22 a toner having the same polarity as the latent image (i.e., a nega-posi mode) is preferably used (see, for example, the above patents relating to the powder cloud developing method, and British Patents 1,152,364, 1,235,894 and U.S. Pat. No. 3,520,681).

The thus-obtained images on layers 22 and 32 are illustrated in schematic form in FIG. 3. That is, two images having different characteristics are separately formed on both sides of support 10 from common original information. According to known image recording methods, such a combination can be obtained by two exposures. However, since increased dosage to patients should be avoided in X-ray image recording, known recording methods are not desired. The method of the present invention removes the disadvantage of known methods.

The above described descriptions were made for the purpose of easily understanding the spirit of the present invention using a typical embodiment. However, in general, the recording layers need not necessarily be formed on a common support, and further various changes and modifications can be made within the spirit and scope of the present invention. For example, two separate recording layers can be used in intimate contact when they are exposed.

A typical recording layer for obtaining an edge enhanced image is a photoconductive insulating layer or a mere insulating layer, for example, a polyester resin layer or other resin layer. The photoconductive insulating layer can utilize direct excitation by X-rays and/or excitation by visible light from a fluorescent intensifying screen excited by X-rays. Further, an assembly used for an inversion electric field method, which comprises an insulating layer formed on a photoconductive insulating layer, can be used.

The inversion electric field method is described in Japanese Patents 2,627/68 (fundamental) and 24,891/72 (combination with a fluorescent layer).

Suitable examples of photoconductive insulating layers include a vacuum evaporated layer on the order of 50–50 $\mu$ thick of selenium or alloys thereof e.g., Se-As, Se-Tl, etc., layers or resins containing PbO, ZnO, $TIO_2$, CdS, or CdSSe, etc., dispersed therein such as silicone resins, alkyd resins, acrylic resins, and the like, containing such components at a size of most preferably 0.05 to 10 microns, and layers of organic photoconductive insulating materials such as polyvinylcarbozole, etc. When a fluorescent intensifying screen is used, the X-ray absorbing ability of the photoconductive insulating layer is not important. However, when a direct excitation is mainly used, substances such as Se, Se-Te, and PbO, etc., are preferred due to their high X-ray absorbance. The photoconductive insulating layers which are used in the present invention are, essentially, conventional. Representative materials which can, in general, be used in the present invention are described in U.S. Pat. Nos. 3,121,006, 3,121,007, 3,008,825 and 3,052,539, Japanese Patents 5,588/67 and 3,917/58, and Belgian Patent 691,757.

In addition to these, the following organic photoconductive materials as described in the following patents can be used, when indirect excitation is utilized.

Non-polymeric organic photoconductive compounds:

1. Oxadiazoles as described in U.S. Pat. No. 3,189,447
2. Thiadiazoles as described in British Patent 1,004,927
3. Triazoles as described in U.S. Pat. No. 3,112,197
4. Imidazolones as described in U.S. Pat. No. 3,097,095
5. Oxazoles as described in British Patent 874,634
6. Thiazoles as described in British Patent 1,008,631
7. Imidazoles as described in British Patent 938,434
8. Pyrazolines as described in U.S. Pat. No. 3,180,729
9. Imidazolidines as described in Belgian Patent 593,002
10. Pyrazines as described in British Patent 1,004,461
11. Triazines as described in U.S. Pat. No. 3,130,046
12. Oxazolones as described in U.S. Pat. No. 3,072,479
13. Quinoxalines as described in Belgian Patent 640,264
14. Quinazolines as described in British Patent 943,606
15. Furans as described in U.S. Pat. No. 3,140,946
16. Acridines as described in U.S. Pat. No. 3,244,516
17. Carbazoles as described in U.S. Pat. No. 3,206,306
18. Phenothiazines as described in British Patent 980,880.

Polymeric organic photoconductive compounds:

1. Polynuclear aromatic vinyl polymers as described in U.S. Pat. No. 3,162,532
2. Vinyl polymers having a heterocyclic ring containing side chains as described in British Patent 964,871 and U.S. Pat. No. 3,037,861
3. Poly-N-vinylcarbazole as described in British Patent 1,122,458

4. Nitrated poly-N-vinylcarbazole as described in Japanese Patent 14,508/66
5. Vinyl polymers which can form inner complexes as described in U.S. Pat. No. 3,418,116
6. Polymers containing brominated vinylcarbazoles as described in U.S. Pat. No. 3,421,891.

The support and the barrier layer or the electroconductive layer formed thereon are not of particular importance in the present invention, therefore they will not be described in detail; examples of typical barrier layers include aluminium oxide on an aluminium support, with selenium or a selenium alloy being vacuum deposited thereon. However, when X-rays are to be passed through the support, materials which absorb X-rays to a low extent are preferred, and when an image is observed through the support, a transparent support and a transparent electroconductive layer are naturally desired. Examples of such materials include films such as polyethylene terephthalate, polycarbonate, etc., having thin layers e.g., less than $1\mu$, of gold, silver, palladium, copper iodide, etc., formed thereon.

For the situation where the recording layers are not photoconductive, i.e., when mere insulating recording layers are used, the so-called ionographic method can be utilized. In ionography, X-rays are directly absorbed by a gas adjacent the recording layer with ion pairs which can be separated by an applied electric field being generated, and ions of the same charge polarity are collected on the recording layer as described in U.S. Pat. No. 2,900,515, Japanese Patent Application (OPI) 82,791/72, German Patent (OLS) 2,226,130; and Zeitschrift fur Angewandte Physik, Vol. 19, p. 1–4, 19 (Feb. 1965).

Recording layers for obtaining edge enhanced images have been described hereinbefore; it should be clear to one skilled in the art that the degree of edge enhancement can be broadly varied by the developing method selected. That is, if a development electrode placed at about the distance of the thickness of the recording layer from the surface of the recording layer is utilized, an image having almost no edge enhancement can be obtained. For the present purpose, developing methods which provide responses clearly decreasing at a spatial frequency of about 5 to 0.1 line pairs/mm or less, more preferably 0.2 to 3 line pairs/mm or less, are preferred (see "Electrophotography" by Schaffert p. 305–306), and the development electrode is placed a distance of more than 10 times the thickness of the recording layer from the recording layer having a thickness of several tens of microns as is typically used for such an insulating layer in the art, generally from about 10 to 250 microns. Further, too long a development is preferably avoided, i.e., overdevelopment is avoided because it decreases edge enhancement.

Examples of developing methods which can be used are a powder cloud developing method, a mist cloud developing method, an electrophoretic developing method, a cascade developing method, a magnetic brush developing method, etc. All these developing methods have common characteristics in that they are all external developing methods utilizing lines of electric force formed outward from the latent image electrostatic charges near the surface of (or inside) the recording layer (e.g., as described in R. M. Schaffert, *Electrophotography*, p. 285–316, The Focal Press, (London)).

Recording layers for obtaining the second image will now be described. Typical recording layers are so-called internal electrophotographic layers such as a frost recording layer, a photoelectrophoretic recording layer, a photomigration recording layer, a manifold recording layer, etc. Subtractive electrophotography is the general name for those methods image-wise utilizing the electric field formed in the recording layer, and it features development essentially without an edge effect.

Each recording method is described in the following references and patents:

Frost method: Gaynor, *IEEE. ED*-19 (4) p. 512–523 (1972) Gundlack & Claus; *Phot. Sci. & Eng.*, 7, p. 14–19 (1963) and U.S. Pat. Nos. 3,196,008, 3,196,009 and 3,196,011.

Photomigration method: Goffe, *Phot. Sci. & Eng.*, 15 (4) p. 304–308 (1971); Japanese Patents 10,796/68 and 13,513/68; and British Patent 1,152,365.

Photoelectrophoretic method: Tulagin, *J. Dpt. Soc. Am.* 59 (3) p. 328–331 (1969); Japanese Patent 21,781/68; and British Patent 1,124,625.

Manifold method: Japanese Patents 24,609/72 and 26,053/72; U.S. Patent 3,512,968.

Other methods (based on an electric latent image, which term in this specification includes both electrostatic and electroconductive latent images) for obtaining non-edge enhanced images are as follows:

i. A careful development of that described hereinbefore to obtain an edge-enhanced image. For instance, if an electrostatic latent image on the photoconductive insulating layer (or mere insulating layer) is developed using a development electrode for a sufficiently long period of time, it is possible to obtain an image having no edge enhancement.
ii. An electrolytic-electrophotographic method wherein an electroconductive latent image is electrolytically developed or a charging developing method similar thereto can be used.

The former is, for example, described in Japanese Patents 6,669/59 (U.S. Pat. No. 3,010,883), 12,524/60, 2,094/63, 9,600/64 and 11,544/64, and the latter is described in U.S. Pat. Nos. 2,956,874, 2,990,280 and 2,976,144.

As to the layer constitution for all these recording methods, materials having a large X-ray absorbance are advantageous when X-ray absorption of the layer is important, and various conventional materials can be used when an indirect excitation is used.

Any combination of these elements can be used; however, the use of a common support is definitely superior in registration (particularly in viewing) of the two images. On the other hand, if separate supports are used, the degree of freedom in designing the device increases.

In general, when two images are recorded at the same time, particularly, where a common support is used, the following precautions should be taken.

First of all, processes such as image exposure, developing, etc., of each recording layer should be carried out so that they do not interfere with each other. Examples of such methods as follows:

i. When an edge enhanced image is formed on a photoconductive insulating layer using the Carlson method with direct excitation of X-rays to avoid a decrease in image sharpness, and when, on the other hand, a non-edge enhanced image is obtained using a photomigration method with visible light from a fluorescent layer as shown in FIGS. 1 through 3, the common support should be opaque to light from the fluorescent layer so that formation of the first image is not affected by the light.

ii. When one latent image is heat-developed and the other latent image is not resistant to the temperature of the heat-developing, the latent image which is not resistant to heat is developed first, and then heat-development is carried out. Use of separate supports simplifies this process.

iii. The photomigration method and the Carlson method are used in combination as shown in FIGS. 1 through 3, and when the former utilizes a solvent development and the latter a dry development, the development treatments should be separated or carried out at different times to prevent each developer from smearing the other recording layer.

When formation of the first latent image is by ionography and formation of the second latent image is by photomigration and these methods are combined, a transparent support can be used since the recording layer for ionography is not sensitive to light. This is a highly desirable embodiment of the present invention.

Considering the advantage in viewing images obtained, it is desired to differentiate the hues of the two images so that only one image or both images in registration can be viewed as desired. Typical examples of hue differentiation methods are those involving complementary color relation such as red-cyan, green-magenta, and blue-yellow. Also, combinations of the three primary subtractive colors such as cyan-magenta, cyan-yellow, and magenta-yellow can be used. These color combinations can be broader if they are more than 6 divisions apart in the color circle of the Munsell notation system having 100 divisions. Combinations having differences of 15 to 20 divisions or more are more preferred.

The thus obtained images can be fixed without transferring or fixed after transferring. When one recording layer is formed on an opaque support and the other recording layer on a transparent support, it is preferred to transfer and fix the image on the former recording layer to the opposite surface of the second recording material, from the viewpoint of image relationships.

Preferred examples of image combinations which can be used in practice are as follows.

| | Edge Enhanced Image | Non-edge Enhanced Image |
|---|---|---|
| (i) | Carlson process electrophotography | Photomigration recording method |
| (ii) | Carlson process electrophotography | Photoelectrophoretic recording method |
| (iii) | Ionographic method | Photomigration recording method |
| (iv) | Ionographic method | Photoelectrophoretic recording method |
| (v) | Inversion electric field electrophotography | Photomigration recording method |
| (vi) | Inversion electric field electrophotography | Photoelectrophoretic recording method |
| (vii) | Carlson process electrophotography (edge enhanced development) | Carlson process electrophotography (Non-edge enhanced development) |
| (viii) | Carlson process electrophotography (Edge enhanced development) | Combination of ionography and Photomigration recording method |
| (ix) | Ionographic method (Edge enhanced development) | Ionographic method (Non-edge enhanced development) |

As a practical embodiment for combination (ix), one can use two insulating charge receiving layers having a widely different thickness from each other, whereby on the thicker layer an edge-enhanced image, and on the thinner layer a non-enhanced image, can be obtained. One can also realize the same results by controlling development conditions for two charge receiving layers of a similar thickness.

The Carlson process typically comprises: uniformly charging a photoconductive insulating layer which is formed on conductive support; imagewise exposing the thus charged layer to obtain an electrostatic latent image thereon and toner developing the electrostatic latent image to render the same visible. For details, see U.S. Pat. No. 2,297,691.

The photomigration recording method typically comprises: uniformly charging a photosensitive layer which comprises a softenable layer and photoconductive particulate material dispersed therein and exposing and softening the layer by the action of heat and/or a solvent, whereby the particulate material imagewise migrates towards the substrate to yield a visible image.

Instead of uniformly charging the layer, one can form an electrostatic latent image on a sensitive layer which comprises a softenable layer with a particulate material dispersed therein and soften the layer by heat and/or a solvent to cause the image-wise migration referred to; see British Patents 1,152,365 and 1,235,894 and U.S. Pat. No. 3,520,681.

The photoelectrophoretic recording method typically comprises: image-wise exposing a photosensitive suspension positioned between two electrodes, the suspension comprising a photoconductive particulate material and an electrically insulating liquid, while applying an electric potential between the electrodes, whereby the particulate material is distributed in an imagewise-fashion on at least one of the electrodes, to yield a visible image. See U.S. Pat. No. 3,384,565.

The inversion electric field method typically comprises: uniformly charging the surface of a sensitive material which comprises a photoconductive layer formed on an insulating layer carried on a conductive support, image-wise exposing the sensitive material, and charging the surface of the sensitive material, simultaneously with said exposing, to a polarity opposite to that of the first uniform charging. See British Patents 1,172,873, 1,165,405-7 and U.S. Pat. No. 3,666,365.

The ionographic method is disclosed in, for example, W. German Patent (OLS) 2,258,364, H. E. Johns, A. Fenster and D. Plewes *Radiation Physics* Vol. 116 p. 415 (1975) and A. T. Prondian *Radiology* Vol. 110 p. 667 (1974).

The following examples are given to illustrate the present invention in greater detail.

EXAMPLE 1

On a palladium metal layer vacuum (50 – 150 μ thick) evaporated on a polyethylene terephthalate film having a thickness of 100μ (Tore High Beam, made by Tore Co., Ltd.) a water dispersion of colloidal alumina (avg. size: less than 1μ) was coated to obtain a dry coating of alumina in an amount of 2 g/m², and then a coating solution having the following composition was coated thereon to form a photomigration coating layer of a dry thickness of about 5μ.

| Coating Solution | |
|---|---|
| 40 wt% toluene solution of hydrogenated rosin - glycerin ester (Stabelite Resin, trade name of Hercules Powder Co.) | 25 parts by weight |
| β-copper phthalocyanine (C.I. Pigment Blue 15) | 1 part by weight |

(The composition was dispersed in a sand mill and then further dispersed in a ceramic ball mill for 10 hours.)

Separately, an aluminum support having a thickness of 1 mm was anodized to a depth of several hundred angstroms in a conventional manner, and then selenium was vacuum deposited on one surface thereof. The vacuum deposition was performed at a support temperature of 50° C and a deposition rate of 3μ/min. The thickness of the deposited selenium layer was 120 to 130μ. On this surface there was coated a solution of polyvinyl formal (molecular weight: 45,000 – 55,000, vinyl alcohol units: 9 – 13% by weight) dissolved in a mixture of 1:1 by volume of methyl cellosolve and ethyl acetate to obtain a layer of a dry thickness of 3 to 4μ.

Before the thus obtained recording materials were exposed to X-rays, the phthalocyanine containing layer of the first recording material was charged to −500V and the selenium layer of the second recording material was charged to +700V.

These recording materials were positioned in such a manner that the first recording layer (copper phthalocyanine) was closer to the radiation source and the second recording layer (Se layer) faced the rear or non-coated surface of the first recording material.

Facing the first recording layer, a fluorescent intensifying screen containing a $Gd_2O_2S$: Tb fluorescent substance was placed as shown in FIG. 4 (see X-ray Exposure Reduction Using Rare Earth Oxysulfide Intensifying Screens by R. A. Buchanan, Radiology 105: 185–190, Oct. 1972). β-copper phthalocyanine has a photoconductive response in almost all regions of the spectrum and is intensified by fluorescent light from $Gd_2O_2S$: Tb.

The X-ray light which was transmitted by the phantom was projected onto the two recording layers.

Their radiation conditions for exposure were as follows: tube voltage: 70 KVp, current: 100 mAs, distance from the radiation source: 1 m.

Following exposure, the first recording material was immersed in xylene at room temperature for 3 min., and then rinsed by immersing in kerosene for 15 min. at room temperature. By immersion in xylene the pigment at the exposed areas migrated toward the surface of the support, and a negative image was obtained. By rinsing in kerosene, fog was decreased.

A non-edge enhanced image having continuous gradation was thus obtained.

On the other hand, the second recording material was cascade developed with a cascade developer which comprised a carrier consisting of 0.5 – 0.7 mm glass beads with nitrocellulose coated thereon and a toner (the toner: carrier ratio was about 1:100) consisting of 20 parts by weight of 3,3-dichlorobenzidine acetoacetanilide yellow pigment and 80 parts by weight of a styrene: methylmethacrylate: butylmethacrylate (50:30:20 by weight) copolymer resin (toner size: 20 – 30μ), to obtain an edge enhanced image.

The thus obtained toner image was transferred to the rear surface of the first recording material in registration, and then fixed with a solvent (trichloroethylene vapor; saturated; contact time = 5 minutes at room temperature).

Only the first image was viewed when a red filter was used, only the second image was viewed when a blue filter was used, and both images in registration were viewed when a magenta filter was used.

EXAMPLE 2

The same procedures as described in Example 1 were carried out except for the following changes. Firstly, a yellow pigment represented by the formula.

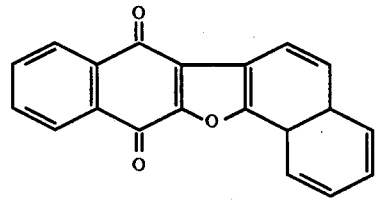

(Quinonefuran pigment about 1μ avg. particle size) was used instead of the photosensitive pigment of the first recording material, the charge potential of the first recording material was −250V, and a $CaWO_4$ type fluorescent screen was used instead of $Gd_2O_2S$: Tb. Further, development of the second recording layer was by powder cloud developing method using β-copper phthalocyanine; the toner acquired a positive charge and reversal development was carried out.

Thus, a yellow image having continuous gradation and a cyan edge enhanced image was obtained.

The first recorded image was viewed only when a blue filter was used, and the second image only when a red filter was used. Without a filter, both images could be viewed simultaneously.

EXAMPLE 3

On both surfaces of a polyethylene terephthalate film having a thickness of 100μ, gold was vacuum deposited to a thickness of 50 A to obtain transparent electroconductive layers.

One one gold deposited layer there was coated a subbing layer of polyvinyl acetate having a thickness of 2μ, and then a polyvinyl carbazole (PVK) layer having a dry thickness of 5μ was coated thereon; further, selenium (Se) was vacuum deposited thereon to a thickness of 0.5μ.

On the other hand, on the other gold deposited layer there was formed a photomigration recording layer [as described in Example 2] containing quinonefuran pigment to a dry thickness of 5μ.

The Se/PVK layer was charged to +700V, and the quinonefuran layer to −250V; further, a fluorescent screen containing a $Gd_2O_2S$: Tb fluorescent substance as described in Example 1 was placed in intimate contact with the former layer and a fluorescent screen containing a $CaWO_4$ fluorescent substance was placed in intimate contact with the latter layer, and the system then exposed to an X-ray image at 60 KVp, 100 mAs, 80 cm.

The Se/PVK layer was subjected to a powder cloud development (see "Xerography and Related Processes," Dessauer, Focal Press) using a copper phthalocyanine toner having a positive polarity, and the quinonefuran layer was subjected to a migration development using xylene and then rinsed using an isoparaffinic solvent (Isopar H from Esso).

The treatments were in the following order: powder cloud development; fixing of the toner image by lacquer coating (a 70:30 by weight mixture of nitrocellulose and polymethylmethacrylate), development of the quinonefuran layer, and rinsing.

EXAMPLE 4

Pallladium (ca. 50 A – 250 A thick) was deposited by sputtering on one surface of a polyethylene terephthalate film having a thickness of 100$\mu$ to obtain an electroconductive layer having a surface resistance of $10^5$ to $10^6$ $\Omega$ □. On this sputtered layer there was coated colloidal alumina at a dry coating amount of 2 g/m$^2$; further, the photomigration recording layer as described in Example 2 was formed thereon.

After drying, the surface of the polyethylene terephthalate film of this recording material was discharged to less than 1 volt surface potential. Then, with the palladium layer grounded, the photomigration recording layer was charged to −250V. The recording material was mounted on a holder therefor in such a manner that the rear (uncoated) surface of the polyethylene terephthalate film faced a high pressure chamber for ionography, with a $CaWO_4$ fluorescent screen in contact with the photomigration recording layer (actual contact is not per se required; e.g., at 50$\mu$ distance equivalent results are obtained). The chamber for ionography was as shown in FIGS. 5 and 6 of Japanese Patent Application (Open Public Inspection) 82,791/73 and 1,200V charge was applied between the palladium layer and the cathode of the chamber; the distance between the cathode and the rear surface of the polyethylene terephthalate film was 5 mm and the gap was filled with xenon gas at 10 atm.

An X-ray source was placed so that an X-ray image would first reach the fluorescent layer and then the xenon gas layer.

During exposure, ionized gas deposited on the surface of the polyethylene terephthalate film to form a latent image having a positive polarity.

The recording material was then taken out of the chamber and powder cloud developed in a conventional manner using copper phthalocyanine in the form of a fine powder to render the latent image visible (reversal development).

On the other hand, the photomigration recording layer was developed by xylene and a non-edge enhanced image was obtained.

EXAMPLE 5

The same procedures as described in Example 4 were carried out except that a negative corona discharge (−7 Kv) was applied to the powder of the powder cloud developer when it was applied to the surface of the latent image to obtain a positive edge enhanced image.

EXAMPLE 6

A transparent electroconductive layer of copper iodide (thickness: 300 A) was vacuum evaporated on one surface of a polyethylene terephthalate film having a thickness of 100$\mu$, a subbing layer of polyvinyl acetate having a thickness of 2$\mu$ was formed thereon, and further a double-layer photosensitive layer as described in Example 3 (PVK layer and vacuum deposited Se layer as the photoconductive layer) was formed thereon. The rear surface of the polyethylene terephthalate film (the surface of the PET which does not have a conductive layer thereon; while in Example 3 the PET had conductive layers on both sides, in this Example only the double layer photosensitive layer was the same as in Example 3, with the PET having a conductive layer on one side only) was used as an image receiving surface for photoelectrophoretic recording, i.e., the construction shown in FIG. 5 was used.

The photoelectrophoretic liquid layer used was a mixture of 100 parts by weight of an isoparaffinic solvent (Isopar H, trade name, a product of Esso Standard Oil Co.), 1 part by weight of the yellow pigment as described in Example 2, and 5 parts by weight of a laurylmethacrylate/acrylate acid copolymer (97:3 by weight). The thickness of this liquid layer was about 20$\mu$.

The liquid layer was exposed to an X-ray image with a voltage of 500V applied between the copper iodide ($Cu_2I_2$) layer and a conventional NESA electrode as shown by 52 in FIG. 5.

Upon removing the NESA electrode, a negative image having no edge enhancement was obtained on the polyethylene terephthalate film.

On the other hand, the selenium layer on the polyethylene terephthalate film was charged to +800V and was exposed to fluorescent light from a $CaWO_4$ fluorescent screen, and an electrostatic latent image was formed thereon. The latent image was positively developed using a copper phthalocyanine powder as in Example 4.

Powder development resulted in an edge enhanced image; overall results were similar to these of Example 1.

EXAMPLE 7

The exposure of Example 6 was varied so that visible light from a fluorescent lamp was used, i.e., the fluorescent screen was removed. At the midpoint of the exposure, a blue filter was inserter between the lamp and the selenium layer because the selenium layer has high sensitivity, and exposure of the photosensitive liquid layer was continued. A 20 Watt fluorescent lamp placed 1 m from the sensitive material was used; the Se layer was exposed for a total of about 1 second, and the photosensitive liquid layer was exposed a total of about 10 seconds.

The image on the selenium plate was edge enhanced and the other image was non-edge enhanced.

EXAMPLE 8

The transparent electroconductive layer of copper iodide ($Cu_2I_2$), the subbing layer of polyvinyl acetate, and the Se/PVK photosensitive layer described in Example 6 were applied in this order to both surfaces of a 150$\mu$ polyethylene terephthalate film.

Both photosensitive layers were charged to +800V, and the recording material was sandwiched between two $Gd_2O_2S$: Tb fluorescent screens, and then exposed to an X-ray image at 80 KVp, 50 mAs, 80 cm. The recording layer closer to the radiation source was powder cloud developed (see Xerography and Related Processes by Dessauer, J. H. et al, Focal Press, p. 318–321) using a copper phthalocyanine powder having a positive polarity without using a development electrode (reversal development).

The other recording layer was developed with a liquid developer prepared by dispersing a concentrated magenta toner in kerosene and a development electrode 0.5 mm from the recording layer and a voltage of +400V applied thereto to obtain an image having almost no edge enhancement.

The magenta concentrated toner was an intimate mixture of 50 parts by weight of a rosin modified phenol-formaldehyde resin, 30 parts by weight of quinacridone magenta of an average size of about 0.0521 $\mu$, and 20 parts by weight of linseed oil.

While the invention has been described in detail and with reference to specific embodiments thereof, it will be apparent to one skilled in the art that various changes and modifications can be made therein without departing from the spirit and scope thereof.

What is claimed is:

1. An image recording method using image-wise modulated radiation comprising forming electric latent images of the image-wise modulated radiation on two recording surfaces, said surfaces being on opposite sides of a support; and then converting said electric latent images to an edge enhanced first image and a second image non-edge enhanced, or edge enhanced to a lesser degree in comparison with said first image, wherein said first and second images are formed from said latent image using one of the following combinations (i) - (ix):

| | Edge Enhanced First Image | Non-edge Enhanced Second Image |
|---|---|---|
| (i) | Carlson process electrophotography | Photomigration recording method |
| (ii) | Carlson process electrophotography | Photoelectrophoretic recording method |
| (iii) | Ionographic method | Photomigration recording method |
| (iv) | Ionographic method | Photoelectrophoretic recording method |
| (v) | Inversion electric field electrophotography | Photomigration recording method |
| (vi) | Inversion electric field electrophotography | Photoelectrophoretic recording method |
| (vii) | Carlson process electrophotography | Carlson process electrophotography |
| (viii) | Carlson process electrophotography | Combination of ionography and Photomigration recording method |
| (ix) | Ionographic method | Ionographic method |

2. The method as described in claim 1, wherein said first image is obtained by a recording method using an external electric field generated by said electric latent image and said second image is obtained by a recording method using an internal electric field generated by said electric latent image.

3. The method as described in claim 2, wherein said edge enhanced image is formed by image-wise exposing a uniformly charged photoconductive insulating layer to form an electrostatic latent image and developing the thus formed latent image to provide a visible image by depositing charged particles by electrostatic interaction, while said non-edge enhanced image is formed by image-wise exposing a uniformly charged photosensitive layer which comprises a softenable layer and a photoconductive particulate material dispersed therein and then softening said layer by the action of heat and/or a solvent, whereby said particulate material image-wise migrates towards a substrate to provide a visible image.

4. The method as described in claim 2, wherein said edge enhanced image is formed by image-wise exposing a uniformly charged photoconductive insulating layer to form an electrostatic latent image and developing the thus formed latent image to provide a visible image by depositing charged particles by electrostatic interaction, while said non-edge enhanced image is prepared by image-wise exposing a photosensitive suspension positioned between two electrodes, said suspension comprising a photoconductive particulate material and an electrically insulating liquid, while applying an electric potential between said electrodes, whereby said particulate material is distributed in an imagewise - fashion on at least one of said electrodes to yield a visible image.

5. The method as described in claim 2, wherein said recording method using an external electric field is an ionographic recording method and said recording method using an internal electric field comprises image-wise exposing a uniformly charged photosensitive layer which comprises a softenable layer and a photoconductive particulate material dispersed therein and then softening said layer by the action of heat and/or a solvent, whereby said particulate material image-wise migrate towards a substrate to provide a visible image.

6. The material as described in claim 2, wherein said recording image using an external electric field is an ionographic recording method and said recording method using an internal electric field comprises image-wise exposing a photosensitive suspension positioned between two electrodes, said suspension comprising a photoconductive particulate material and an electrically insulating liquid, while applying an electric potential between said electrodes, whereby said particulate material is distributed in an imagewise-fashion on at least one of said electrodes to yield a visible image.

7. The method as described in claim 2, wherein said recording method using an external electric field comprises uniformly charging the surface of a sensitive material which comprises a photoconductive layer formed on an insulating layer carried on a conductive support, image-wise exposing said sensitive material, and charging the surface of said sensitive material, simultaneously with said exposing, to a polarity opposite to that ot the first uniform charging, and said recording method using an internal electric field comprises image-wise exposing a uniformly charged photosensitive layer which comprises a softenable layer and a photoconductive particulate material dispersed therein and then softening said layer by the action of heat and/or a solvent, whereby said particulate material image-wise migrate towards a substrate to provide a visible image.

8. The method as described in claim 2, wherein said recording method using an external electric field comprises uniformly charging the surface of a sensitive material which comprises a photoconductive layer formed on an insulating layer carried on a conductive suppot, image-wise exposing said sensitive material, and charging the surface of said sensitive material, simultaneously with said exposing, to a polarity opposite to that of the first uniform charging and said recording method using an internal electric field comprises image-wise exposing a photosensitive suspension positioned between two electrodes, said suspension comprising a photoconductive particulate material and an electrically insulating liquid, while applying an electric potential between said electrodes, whereby said particulate material is distributed in an imagewise-fashion on at least one of said electrodes to yield a visible image.

9. The method as described in claim 1, wherein said first image is obtained by a process which comprises image-wise exposing a uniformly charged photoconductive insulating layer to form an electrostatic latent image and developing the thus formed latent image to provide a visible image by depositing charged particles by electrostatic interaction, without a development electrode, and said second image is obtained by a process which comprises image-wise exposing a uniformly charged photoconductive insulating layer to form an electrostatic latent image and developing the thus formed latent image to provide a visible image by depositing charged particles by electrostatic interaction, with a development electrode.

10. The method as described in claim 1, wherein said first image is obtained by the process which comprises image-wise exposing a uniformly charged photoconductive insulating layer to form an electrostatic latent image and developing the thus formed latent image to provide a visible image by depositing charged particles by electrostatic interaction, without a development electrode, and said second image is obtained by a method comprising irradiating a material capable of generating photoelectrons, as charged particles, or a gas capable of being dissociated, as charged particles, according to the impinging intensity of ionizing radiation, with ionizing radiation containing image information, collecting the charged particles with the aid of an external electric field onto the surface of a recording material comprising an electrically insulating material and pigment particles, said insulating material being softenable or dissolvable with a solvent or softenable or meltable by heat and said pigment being capable of retaining an electrostatic charge thereon, thus forming an electrostatic latent image corresponding to the image information, and when the recording material includes a solvent-softenable or dissolvable material applying a solvent to the recording material or when the recording material includes a heat-softenable or meltable material, heating the recording material to form a visible image, whereby the pigment particles selectively deposit to form an image pattern.

11. The method as described in claim 1, wherein said first image and said second image have different hues from each other.

12. The method as described in claim 11, wherein a combination of said different hues is one selected from the group consisting of red-dyan, green-magenta, blue-yellow, cyan-magenta, cyan-yellow, and magenta-yellow.

13. The method as described in claim 1, wherein said radiation is radiation which is transmitted through an object and/or a visible light generated based in an image-wise pattern in response to said transmitted radiation.

14. The method as described in claim 13, wherein said radiation comprises X-rays.

* * * * *